United States Patent [19]

Martin

[11] Patent Number: 4,548,011

[45] Date of Patent: Oct. 22, 1985

[54] PREFABRICATED SHINGLE PANEL

[76] Inventor: Otis S. Martin, 4291 Stevenson #30, Fremont, Calif. 94538

[21] Appl. No.: 555,440

[22] Filed: Nov. 25, 1983

Related U.S. Application Data

[63] Continuation of Ser. No. 294,832, Aug. 21, 1981, abandoned.

[51] Int. Cl.[4] ..... E04D 1/20

[52] U.S. Cl. ..... 52/551

[58] Field of Search ..... 52/343, 420, 551, 552, 52/748, 553, 518, 540, 521, 557, 519, 542, 541

[56] References Cited

U.S. PATENT DOCUMENTS

| | | | |
|---|---|---|---|
| 2,268,636 | 1/1942 | Becher . | |
| 2,276,170 | 3/1942 | Elmendorf | 52/551 |
| 2,384,686 | 9/1945 | Kraus . | |
| 2,636,226 | 4/1953 | Holland | 52/553 |
| 2,934,110 | 4/1960 | Barker . | |
| 2,965,531 | 12/1960 | Barker . | |
| 3,125,919 | 3/1964 | Barker . | |
| 3,190,040 | 6/1965 | Theobald | 52/420 |
| 3,252,257 | 5/1966 | Price | 52/420 |
| 3,434,259 | 3/1969 | Corbin | 52/420 |
| 3,440,777 | 4/1969 | Martin . | |
| 3,640,044 | 2/1972 | Watts | 52/551 X |
| 3,771,271 | 11/1973 | Keel | 52/540 |
| 3,844,082 | 10/1974 | Martin et al. . | |
| 3,866,378 | 2/1975 | Kessler | 52/519 |
| 3,868,802 | 3/1975 | Schubach . | |
| 3,884,737 | 5/1975 | Bansford, Jr. | 52/747 X |
| 4,050,209 | 9/1977 | Barker et al. . | |
| 4,102,107 | 7/1978 | Barker et al. . | |

*Primary Examiner*—John E. Murtagh

*Attorney, Agent, or Firm*—Jack M. Wiseman

[57] ABSTRACT

A prefabricated panel for use in constructing a roof or a wall surface has the appearance of a shingled surface on which shingles have been positioned and secured one by one. The panel may be formed in one piece or it may consist solely of shingles and transverse mounting strips so oriented and secured together that the panel has an exceptional ability to resist loads. Whether made in one piece or from a plurality of members, the panel is arranged so that any one of a plurality of cuts can be made in the panel without destroying the integrity or usability of either of the several parts of the panel.

8 Claims, 8 Drawing Figures

PREFABRICATED SHINGLE PANEL

This application is a continuation of Ser. No. 294,832 filed Aug. 21, 1981, now abandoned.

BACKGROUND OF THE INVENTION

In constructing a shingle roof or wall, it is conventional to position and secure the shingles in place one-by-one. To shorten the construction time, shingles are sometimes pre-assembled on a suitable backing strip to form a part of a single course. It has also been proposed to pre-assemble a panel containing several courses of shingles so that the installation time can be further reduced. However, it has been found that panels must be cut to accommodate walls of different heights and to permit accurate fitting around windows, doors and the like and, since the proposed panels do not permit cutting without considerable waste, they are not in general use at this time. The present invention concerns pre-assembled panels, and particularly features a panel that can be cut transversely at any one of a plurality of courses in such a way that the appearance and structural integrity of the unused part of the panel is unchanged and the heretofore discarded part of a panel can be used in the continued construction of the wall or roof.

This invention also features a unique panel construction that results in a panel which is strong enough to accommodate all normal loads without the backing of plywood sheathing or the like. Another feature of the invention is a novel method of making inconspicuous the joinder line between two side-by-side panels.

The patents to Watts U.S. Pat. No. 3,640,044, and to Kraus U.S. Pat. No. 2,384,686 disclose panels having more than one course assembled on a backing member. The patents to Martin et al., U.S. Pat. No. 3,844,082, to Barker U.S. Pat. No. 3,125,919, to Barker U.S. Pat. No. 2,934,110, to Barker U.S. Pat. No. 4,102,107, to Barker U.S. Pat. No. 4,050,209, and to Barker U.S. Pat. No. 2,965,531 disclose one-course panel strips, while the patents to Martin, U.S. Pat. No. 3,440,777 and to Becker, U.S. Pat. No. 2,268,636 concern devices for obscuring the joinder line between adjacent strips or panels.

SUMMARY OF THE INVENTION

A shingle panel is formed in one piece or by assembling a plurality of shingles and transverse mounting strips in an arrangement such that a rigid structure is formed which can be cut transversely at any one of the several courses in such a manner that the structural integrity of the portion of the panel below the cut is maintained and the lower end of the part of the panel above the cut will have an overhanging lower edge which will allow that edge to be secured in overlapping relation with the upper edge of a panel or panel section already in place. When the panel is formed of individual shingles and transverse mounting strips, transverse rigidity is provided by positioning the strips so that, near the upper edge of each course, a mounting strip is secured to each side of a shingle. When the panel is installed on a roof or a wall, the pair of strips at each course is disposed transversely to the rafters of the roof or the studs of the wall, one strip substantially directly above the other. When the panel is nailed to the rafters or studs, by nailing through the mounting strips, each pair of spaced strips with the shingle therebetween forms a relatively stiff, substantially unbending unit when subjected to normal loads such as a man walking across a roof or a ladder being braced against a side wall.

DESCRIPTION OF A PREFERRED EMBODIMENT

Figure 1:
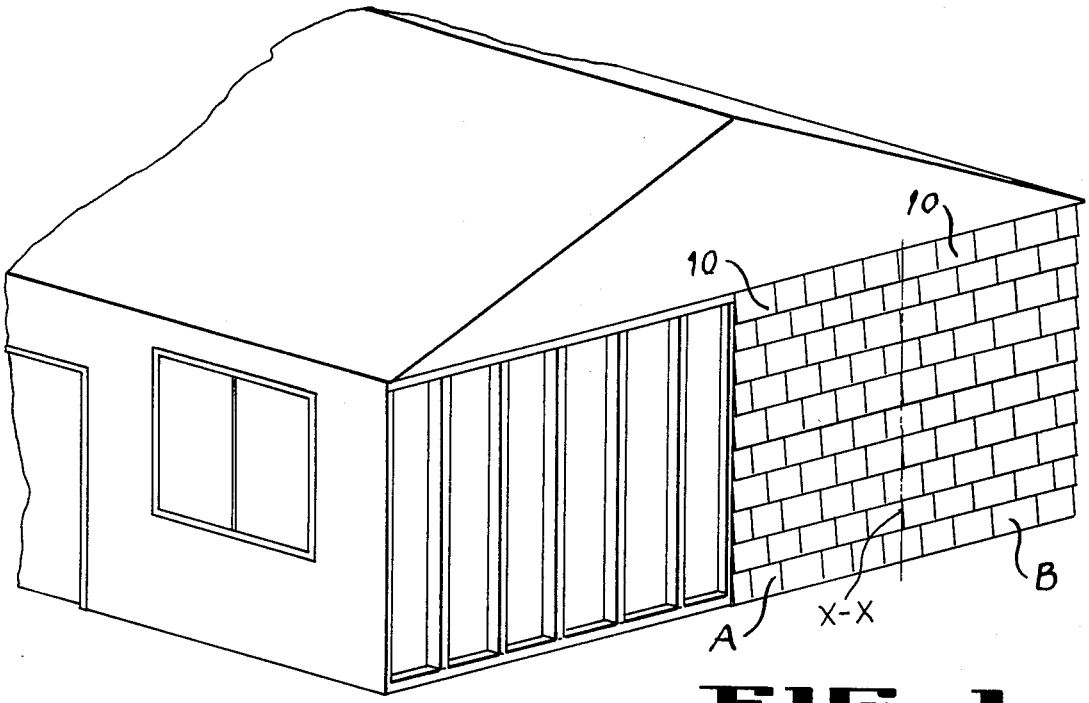
FIG. 1 is a fragmentary isometric view of a house having two panels, constructed in accordance with the teaching of the present invention, secured to a partially finished side wall.

In FIG. 1 the reference numerals 10 indicate two panels constructed in accordance with the present invention and secured to the frame members of one wall of a house to form a portion of the exterior facing of the wall. In such an arrangement each panel is approximately 4′ wide and 8′ high. The two panels, A and B, are nailed in side-by-side abutting relation and, as will be explained presently, auxiliary pieces of shingle are strategically secured in place along the abutting vertical joinder line to break the continuity of the line so that, when the wall is finished, it will have the general appearance of a wall constructed by nailing shingles in place one by one.

The term "shingle" is usually understood to mean an elongated wooden board that is about seven-sixteenths of an inch thick at its lower end and tapers to an upper edge that is about one-sixteenth of an inch thick. However, shingles need not be tapered or made of wood and in the present specification the term shingle will be used to indicate a member that can be secured in shingled formation on roofing or siding and is made of any material suitable for such use, including, but not limited to, asbestos, fibre-glass, hardboard, pressed-wood particle board, and various plastic and fibrous mixtures.

Figure 2:
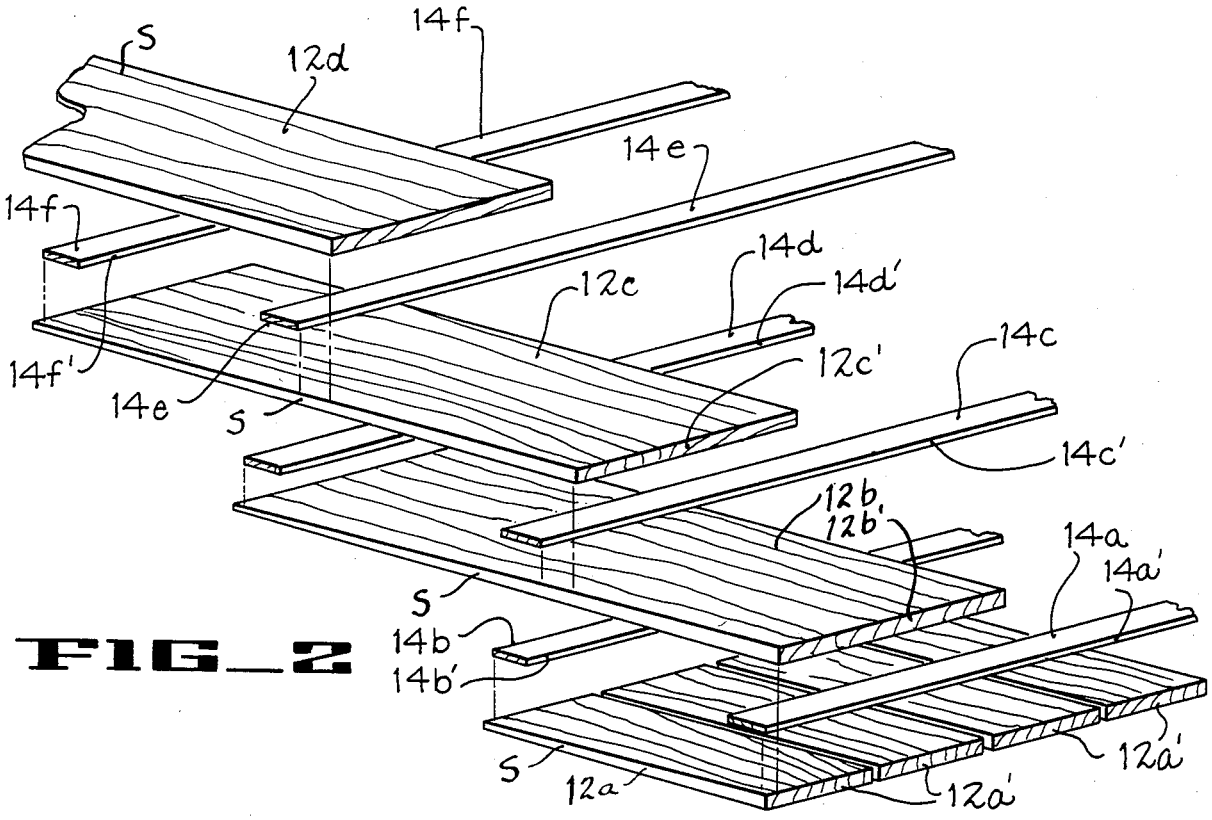
FIG. 2 is an exploded diagrammatic isometric showing the sequence of operations used in fabricating the panel of the present invention.
Figure 4:
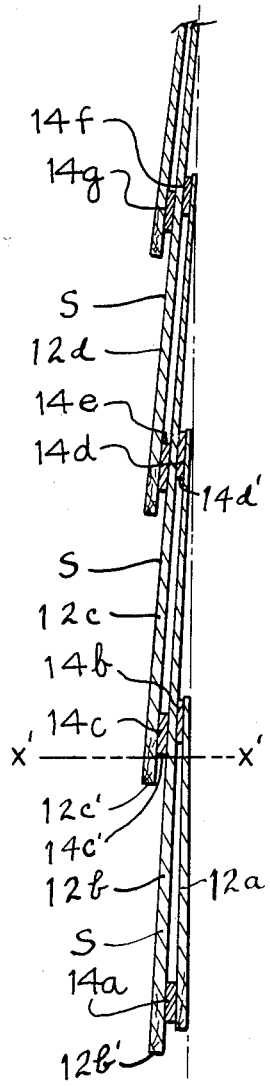
FIG. 4 is a diagrammatic section taken along line 4—4 of FIG. 3.

As seen in FIGS. 2 and 4, each panel comprises a plurality of upright shingles S glued to the upper and lower surfaces of transverse mounting strips which are indicated by the numeral 14 plus a letter suffix. The arrangement is such that two mounting strips underlie each shingle and two strips overlie each shingle. Thus, in FIG. 4, mounting strips 14*a* and 14*b* underlie the lowermost full shingle S and strips 14*c* and 14*d* overlie the shingle. The manner in which each panel is assembled is indicated in FIG. 2 and includes, as a first step, the positioning of a plurality of shingles 12*a* in side-by-side relation on a flat surface to form a base row of shingles that is about four feet wide with the edges 12*a*′ of the shingles is substantial transverse alignment. While shingles come in many lengths, such as 16″, 16″ and 24″, they can be of any desired length, and are of random widths, ranging from about three inches to eight inches. In the describing present embodiment, shingles about 18" in length are used. In this initial step of forming a panel, the shingles 12*a* are not full length shingles but are only about nine inches high. When the base row of shingles 12*a* is in place, two parallel mounting strips 14*a* and 14*b* are secured across the upwardly facing surfaces of the shingles 12*a* by an adhesive. These strips are four feet long, about 1½ inches high, and are made from plywood that is about one-eighth inch thick. The strip 14*a* is positioned so that its front edge 14*a'* is above and generally flush with the lower edges of the shingles. The distance from the front edge 14*a'* of strip 14*a* to the front edge 14*b'* of strip 14*b* is about seven and one-half inches.

After the strips 14*a* and 14*b* are secured to the shingles 12*a*, a row about four feet wide of full-length shingles 12*b* is glued to the upper surfaces of the strips, with the edges 12*b'* of the shingles overlapping the edge 14*a'* of the mounting strip 14*a* by about one inch. Again, the shingles 12*b* are of random widths, and a sufficient number of shingles is used to provide an array of shingles 12*b* that is about four feet wide. Since the shingles 12*b* are of random widths, they are selected so that the crack between any pair of adjacent shingles 12*b* is not directly above a crack between the pair of shingles 12*a* of the base row.

A pair of parallel strips 14*c* and 14*d* is then glued to the upper surfaces of the row of shingles 12*b* with the edge 14*c'* of strip 14*c* positioned about eight and one-half inches from the edges 12*b'* of shingles 12*b*, and the edge 14*d'* of strip 14*d* located about seven and one-half inches from edge 14*c'*. The next course of shingles is then formed, following the above procedure, by gluing a four foot row of shingles 12*c* to the strips 14*c* and 14*d*, gluing spaced strips 14*e* and 14*f* to the upper surface of the shingles 12*c*, and securing a four foot row of shingles 12*d* to the strips 14*e* and 14*f*. It should be noted that the lower edges 12*c'* of shingles 12*c* are seven inches above the edges 12*b'*, and thus each course has an even exposure. Additional courses are added in the same manner until the panel is eight feet high, the shingles of the uppermost course being cut transversely so that this course is about six inches high.

Figure 3:
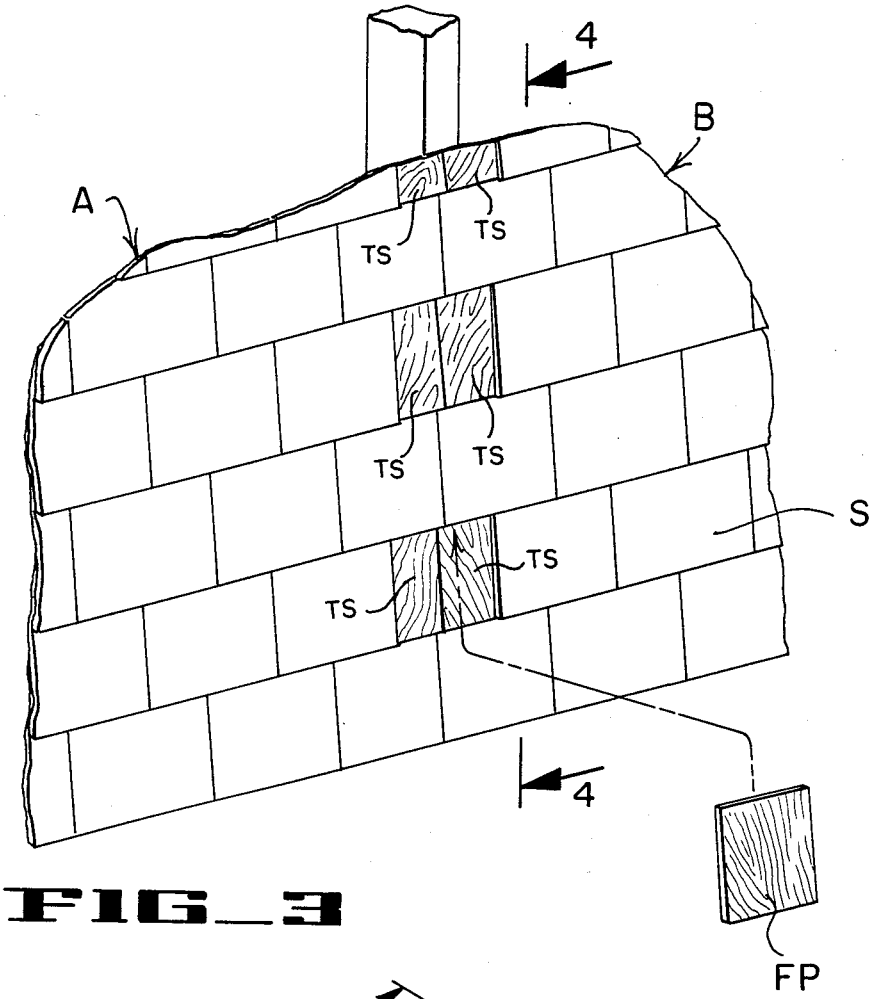
FIG. 3 is an enlarged diagrammatic fragmentary isometric of a portion of a wall using the present panels, particularly showing a unique system for breaking up the line formed between adjacent panels.
Figure 5:
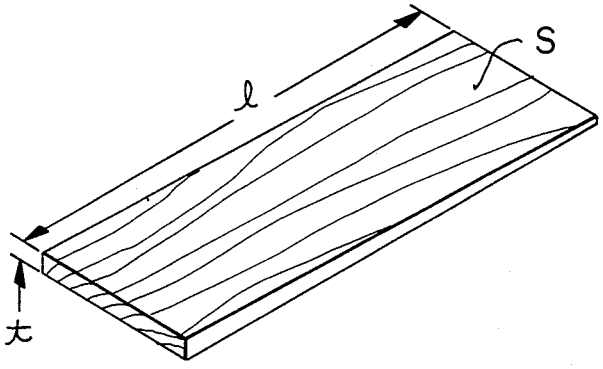
FIG. 5 is an isometric of a conventional full-length shingle made of wood or of another material.
Figure 6:
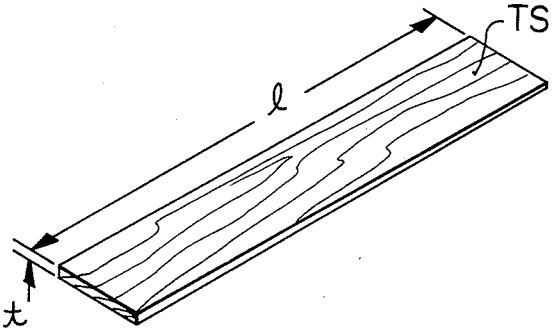
FIG. 6 is an isometric of a thin shingle used in the present invention.

Panels made according to the above-outlined procedure will result in a wall in which the line X—X (FIG. 1) at which the panels abut is visible as a continuous line. In accordance with the present invention, the above procedure is followed except that a change is made in the construction to interrupt the line X—X at every other course, and this arrangement is illustrated in FIG. 3. A typical tapered shingle S (FIG. 5) has a length "1" of about 18 inches, and tapers from its lower edge, where it has a thickness t of about 7/16 of an inch to its upper edge where it is about 1/16 of an inch thick. A second type of shingle, which will be referred to hereinafter as a "thin" shingle TS, is shown in FIG. 6 which is about 18 inches in length and tapers in thickness from a lower edge that is only about 7/32 of an inch thick to its upper edge that is about 1/16 of an inch thick. In accordance with the present invention, conventional shingles S are used throughout the panel except at each side edge of each alternate course of the panel starting with the second course from the lower edge. Thus, if a panel that is eight feet high has fourteen courses, the second, fourth, sixth, eighth, tenth, twelfth, and fourteenth courses will have thin shingles at their side edges. Further, all thin shingles TS have the same width, such as a width of three inches. In FIG. 3, the shingles marked TS in courses 2, 4 and 6 of panels A and B are thin shingles that are each three inches wide. Although these thin shingles are identical in appearance to conventional shingles, they are illustrated as having a grain merely for illustrative purposes. Similar thin shingles are located at the other ends of these courses and at both ends of courses 8, 10, 12 and 14 in a fourteen course panel. Accordingly, when the panels A and B are nailed in upright position on the frame of a wall, each pair of adjacent thin shingles TS together form a recessed surface that is six inches wide and seven inches high. The recess itself has a configuration that corresponds to the configuration of the lower seven inches of a thin shingle that is six inches wide.

Figure 7:
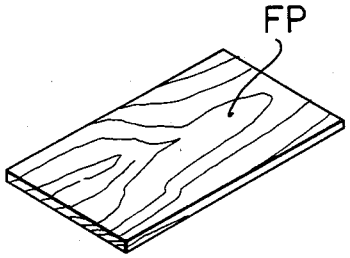
FIG. 7 is an isometric of a filler plate.

To eliminate the discordant appearance that recessed surfaces might present in an otherwise uniformly constructed panel, and to interrupt the continuous vertical seam formed by the abutment of the side edges of the two panels, each recess is filled by a filler plate FP (FIG. 7) that is about six inches wide and has a taper and thickness identical to the taper and thickness of the lower seven inches of a thin shingle. Each filler plate FP is positioned in one of the recesses and is held therein by being fastened, as by nailing, to the top surfaces of the two thin shingles TS.

FIG. 4 illustrates another important feature of the present panel. It is evident that some weather conditions, such as a driving rain, might cause water to pass through the vertical cracks between adjacent shingles. Obviously this water will have a tendency to make its exit from the panel through the vertical cracks in either the front side or the back side of the panel. In FIG. 4 it will be noted that the upper edge of strip 14*b* is at an elevation above the upper edge of strip 14*c*. Similarly, the upper edges of the rear strips 14*d* and 14*f* are at a higher elevation than are the upper edges of the adjacent front strips 14*e* and 14*g*, respectively. Accordingly, the upper portion of each rear strip provides a transverse wall or dam behind the cracks formed between the shingles in front of it. Thus, the dam formed by the forward face of the rear wall will tend to urge the water back onto the forward, lower strip where it will accumulate until it can find its way out through a crack in the forward wall.

As previously mentioned, one of the features of the present invention is the panel construction whereby, if a cut is made transversely part way through the panel at a certain area of each course, the structural integrity of the portion of the panel below the cut is not adversely affected and the part of the panel above the cut will have a lower edge overhanging the cut so that part of the panel can be used in the same manner as the original panel, that is, at the lower end of a wall or of a roof section, or in overlapping relation with an existing wall or roof section.

Referring to FIG. 4, if a cut is made along the line X'—X' without cutting through the lower end of shingle 12*c*, all members of the panel below the cut will remain secured together and thus its structural integrity is not impaired. Also, the part of the panel above the cut will be provided with a lower end having an overhanging edge member, in this case, the lower edges of shingles 12*c*. It is evident that such a partial panel can be used at the base of a wall or roof, or in overlapping relation to the upper end of an existing panel member. It will be understood, of course, that each panel can be cut at any point and in any direction to accommodate the structure being covered. No matter where the cut has been made, the remaining part of the panel can be readied for use, as mentioned above, by making a cut along the next area corresponding to the area indicated by the line X'—X' in FIG. 4, that is, immediately adjacent a pair of mounting strips. The recess formed between the overhanging portion of each shingle and the shingle therebelow provides a space into which a saw can penetrate to make the above-mentioned cut without engaging the underside of the overlying shingle.

In FIG. 2 it will be noted that the mounting strips 14*a* and so forth are disposed transversely to the shingles and therefore they will straddle the vertical frame members of a wall or the rafters of a roof. When the panel is securely nailed to the wall or roof, the pair of cooperating mounting strips, that is, 14*b*–14*c*, 14*d*–14*e*, 14*f*–14*g*, and so forth, at each course straddle the structural frame members. The arrangement wherein the two mounting strips are secured to the same shingle, which holds the strips in spaced relation, provides a beam structure that can effectively resist normal localized loads such as the load imposed by a worker walking across a roof. Since the panel of the present invention is provided with these advantageous load-resisting sections, no additional load-resisting member such as plywood sheathing is necessary.

It is evident that it is desirable to accommodate the height of the courses of a shingle wall or roof to the size of the building, since, while a shingled surface having courses nine inches high may present a good appearance on a large condominium, it would probably be unsuitable for a small cottage. As mentioned above, shingles come in various lengths and, in accordance with the teaching of the present invention, the length of shingle and the spacing between the mounting strips may be adjusted to adapt the strips to the size of shingle and the depth of each course as long as the strips are positioned in opposition to each other at spaced points as described above.

The mounting strips could be made of material other than plywood, such as solid wood, or any material which has a suitable amount of resistance to bending and can be secured to rafters or studs.

Figure 8:
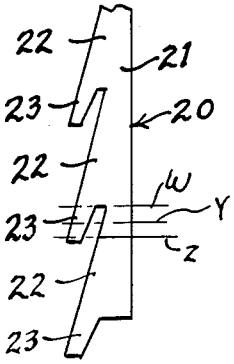
FIG. 8 is a diagrammatic side elevation of the lower end of a panel which is a second embodiment of the invention.

In FIG. 8 a second embodiment 20 of the panel is shown. In this embodiment the entire panel is made in one piece as by casting, molding, pressing or similar techniques. Materials that are particularly suited for such procedures are pressed wood, hardboard, particle board, and various plastic or fibrous mixtures. The panel 20 consists of a body portion 21 to which a plurality of horizontal courses of shingle members 22 are connected. Vertical lines are formed in each course to create the appearance of a plurality of shingles of random widths. Each shingle 22 has a lower edge portion 23 overhanging the base of the shingle next below. It will be understood that the panel can be made in convenient sizes, such as 4' by 8', and that the number of courses and the height of each course can be varied to accommodate the size of building on which the panel is being installed.

A feature of the panel of FIG. 8 is the fact that a cut can be made in any course along a line, such as line Y, at any point between approximately the line W and the line Z, without breaking up or adversely affecting the portion of the panel below the cut, while still providing the portion of the panel above the cut with an overhanging edge 23 and a surface that can be moved into abutting contact with an existing portion of the roof or siding. Again, the recess under the overhanging edge portion 23 facilitates the making of the cut.

The one-piece panel can be formed in any convenient size, such as 4'×8', and the number of courses, the height of each course and the amount of shingle overlap can be selected as desired.

In both embodiments of the invention, each panel has a body portion and shingles having exposed portions overlying the body portion of the panel. In FIG. 4 the body portion comprises the transverse mounting strips and the parts of the shingles underlying the mounting strips. Similarly, the body portion 21 of the one-piece panel 20 may be considered to be these portions that form the body of the panel and are connected to the shingles 22 of any course below the overlapping edge portions of the shingles. The shingles 22 include the exposed portions and the part underlying the overlapping edge portions of the shingles in the course next above.

The gist of the part of the invention that concerns transverse cuts in the panel is that the cut can be made in the body portion of the panel at a point underlying the overlapping parts of the shingles in a course of shingles to separate these shingles from the body portion of the panel that is below the cut.

From the foregoing description it will be apparent that the present invention provides a unique structural arrangement which, for the first time, provides a shingle panel that can be cut to suit the requirements of the installation without destroying the usability of the remainder of the panel and which provides exceptional structural strength.

While I have disclosed a particular embodiment of my invention, it will be understood that some variations of the structure may be made without departing from the spirit and scope of the present invention.

I claim as my invention:

1. A panel construction comprising a plurality of shingles positioned in alignment with one marginal edge of one shingle overlapping a portion of the other shingle, a first transverse mounting strip of a bar construction disposed between the marginal edge of said one shingle and the underlying shingle, means attaching opposite sides of said first mounting strip to confronting surfaces of said one shingle and said underlying shingle respectively, and a second mounting strip of a bar construction secured to the underlying shingle on the side of the shingle opposite to the side where said first mounting strip is attached and in substantially underlying alignment with said first mounting strip, each of said strips having a sufficient thickness to maintain structural integrity for the panel construction and to provide a rigid load support for the panel construction.

2. In a panel construction, three shingles disposed in aligned shingled formation, the central one of said shingles having one marginal edge portion overlapping a portion of a first adjacent shingle and the opposite marginal edge portion underlying a portion of the second adjacent shingle, a first transverse mounting strip of a bar construction disposed between said one marginal edge portion and the adjacent underlying shingle, means attaching opposite sides of said first mounting strip to confronting surfaces of said one marginal edge portion and said adjacent underlying shingle respectively, a second mounting strip of a bar construction disposed between the opposite marginal edge portion and said second adjacent shingle, said second mounting strip being in substantial underlying alignment with said first mounting strip, and means attaching opposite sides of said second mounting strip to confronting surfaces of said opposite marginal edge portion and said second adjacent shingle respectively, each of said mounting strips having a sufficient thickness to maintain structural integrity for the panel construction and to provide a rigid load support for the panel construction.

3. The panel construction of claim 2 including a third mounting strip of a bar construction disposed in generally parallel spaced relation to said second mounting strip and disposed between said central shingle and the overlapping marginal portion of said second adjacent shingle, and means attaching opposite sides of said third mounting strip to confronting surfaces of said central shingle and said overlapping marginal portion of said second adjacent shingle respectively, said third mounting strip having a sufficient thickness to maintain structural integrity for the panel construction and to provide a rigid load support for the panel construction.

4. The panel construction of claim 3 including a fourth mounting strip of a bar construction disposed in generally parallel spaced relation to said first mounting strip and disposed between a body portion of said central shingle and the underlying marginal portion of said first adjacent shingle, and means attaching opposite sides of said fourth mounting strip to confronting surfaces of said body portion of said central shingle and the underlying marginal portion of said first adjacent shingle respectively, said fourth mounting strip having a sufficient thickness to maintain structural integrity for the panel construction and to provide a rigid load support for the panel construction.

5. In a panel construction, three shingles disposed in aligned shingled formation, a first mounting strip of a bar construction disposed between a portion of the central shingle and the underlying shingle, means attaching opposite sides of said first mounting strip to confronting surfaces of said central shingle and said underlying shingle respectively, a second mounting strip of a bar construction disposed between said central shingle and the overlying shingle, said second mounting strip being in substantial underlying alignment with said first mounting strip, sand means attaching opposite sides of said second mounting strip to confronting surfaces of said central shingle and said overlying shingle respectively, each of said mounting strips having a sufficient thickness to maintain structural integrity for the panel construction and to provide a rigid load support for the panel construction.

6. A panel construction according to claim 5 wherein said mounting strips are disposed in a common plane transverse to said shingles and generally normal to the plane of the top surface of said central shingle.

7. A panel construction according to claim 5 and further comprising a third mounting strip of a bar construction disposed in generally parallel spaced relation to said first mounting strip and disposed between said central shingle and said underlying shingle, means attaching opposite sides of said third strip to confronting surfaces of said central shingle and said underlying shingle respectively, a fourth mounting strip of a bar construction in generally parallel spaced relation to said second mounting strip and disposed between said central shingle and said overlying shingle, and means attaching opposite sides of said fourth strip of confronting surfaces of said central shingle and said overlying shingle respectively, said third and fourth mounting strip, respectively, having a sufficient thickness to maintain structural integrity for the panel construction and to provide a rigid load support for the panel construction.

8. In a panel construction, a plurality of shingles positioned in side by side formation to define a first course of shingles, said shingles of said first course of shingles having a back, a second plurality of shingles defining a second course of shingles underlying said first course, said shingles of said second course of shingles having a front and a back, a first mounting strip of a bar construction having opposite sides thereof attached to the back of the shingles of said first course and to the front of the shingles of said second course respectively, and a second mounting strip of a bar construction secured to the back of the shingles of said second course in substantial underlying alignment with said first mounting strip and with the upper edge of said second mounting strip being at a higher elevation than the upper edge of said first mounting strip, whereby the second mounting strip provides a dam resisting passage of water between adjacent shingles of said first course, each of said mounting strips having a sufficient thickness to maintain structural integrity for the panel construction and to provide a rigid load support for the panel construction.

* * * * *